US007824624B2

(12) United States Patent
Bergman et al.

(10) Patent No.: US 7,824,624 B2
(45) Date of Patent: Nov. 2, 2010

(54) CLOSED FLOW-THROUGH MICROPLATE AND METHODS FOR USING AND MANUFACTURING SAME

(75) Inventors: Richard Bergman, Horseheads, NY (US); William J. Miller, Horseheads, NY (US); Mark L. Morrell, Horseheads, NY (US); Todd M. Roswech, Ithaca, NY (US); Po Ki Yuen, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 867 days.

(21) Appl. No.: 11/784,130

(22) Filed: Apr. 5, 2007

(65) Prior Publication Data

US 2007/0237685 A1 Oct. 11, 2007

Related U.S. Application Data

(60) Provisional application No. 60/790,188, filed on Apr. 7, 2006.

(51) Int. Cl.
*B01L 3/00* (2006.01)

(52) U.S. Cl. ..... 422/102

(58) Field of Classification Search ..... 422/102
See application file for complete search history.

(56) References Cited

U.S. PATENT DOCUMENTS

| | | | | |
|---|---|---|---|---|
| 4,815,843 | A | 3/1989 | Tiefenthaler et al. | 356/128 |
| 5,798,215 | A | 8/1998 | Cathey et al. | 435/7.9 |
| 6,200,814 | B1 | 3/2001 | Malmqvist et al. | 436/52 |
| 6,526,812 | B2 | 3/2003 | Martin et al. | 73/61.55 |
| 6,698,454 | B2 | 3/2004 | Sjölander et al. | 137/885 |
| 6,994,826 | B1 | 2/2006 | Hasselbrink et al. | 422/100 |
| 7,175,980 | B2 | 2/2007 | Qiu et al. | 435/4 |
| 2003/0022388 | A1 | 1/2003 | Roos et al. | 436/164 |
| 2003/0049862 | A1 | 3/2003 | He et al. | 436/180 |
| 2003/0082632 | A1 * | 5/2003 | Shumate | 435/7.1 |
| 2004/0084311 | A1 | 5/2004 | Okamoto et al. | 204/450 |
| 2005/0199076 | A1 | 9/2005 | Tidare et al. | 73/863.01 |
| 2006/0106557 | A1 | 5/2006 | Fontaine et al. | 702/87 |
| 2007/0020689 | A1 | 1/2007 | Caracci et al. | 435/7.1 |

FOREIGN PATENT DOCUMENTS

| | | |
|---|---|---|
| EP | 0 153 110 | 8/1985 |
| EP | 1 927 401 | 6/2008 |
| WO | WO03/002955 | 1/2003 |
| WO | WO03/002985 | 1/2003 |
| WO | WO 2005/043154 | 5/2005 |
| WO | WO2006/102516 | 9/2006 |

OTHER PUBLICATIONS

U.S. Appl. No. 60/817,724, filed Jun. 30, 2006, W.J. Miller et al.

* cited by examiner

*Primary Examiner*—Walter D Griffin
*Assistant Examiner*—Bobby Ramdhanie
(74) *Attorney, Agent, or Firm*—Gregory B. Butler; John L. Haack

(57) ABSTRACT

A closed flow-through microplate is described herein that can be used to perform high-throughput kinetic flow-through assays to detect biomolecular interactions like material bindings, adsorptions etc. . . that is helpful for example with testing new drugs. A method for manufacturing the closed flow-through microplate is also described herein.

3 Claims, 5 Drawing Sheets

CLOSED FLOW-THROUGH MICROPLATE AND METHODS FOR USING AND MANUFACTURING SAME

CLAIMING BENEFIT OF PRIOR FILED U.S. APPLICATION

This application claims the benefit of U.S. Provisional Application Ser. No. 60/790,188 filed on Apr. 7, 2006 and entitled "Microplate Flow-Through Assay Device". The contents of this document are hereby incorporated by reference herein.

TECHNICAL FIELD

The present invention relates to a closed flow-through microplate and a method for using the closed flow-through microplate to perform a flow-through assay to detect biomolecular interactions like material bindings, adsorptions etc. . . that is helpful for example with testing new drugs.

BACKGROUND

Instrumentation for label-free high throughput screening is commercially available today and is often used for detecting biomolecular interactions while testing new drugs. The typical label-free interrogation system employs microplates with wells which have biosensors incorporated therein that enable the detection of biomolecular interactions like material bindings, adsorptions etc. . . by monitoring changes in the refractive index at or near the sensing surfaces of the biosensors. For example, each biosensor has a sensing surface on which a ligand can be immobilized so that when an analyte which is in a solution located above the sensing surface interacts with the immobilized ligand then there would be a change in the refractive index. The label-free interrogation system interrogates each biosensor and detects this change in the refractive index and as a result is able to detect/monitor the biomolecular interaction between the immobilized ligand and the analyte which is useful while testing new drugs.

The typical microplate includes an open array of wells which are aligned with an array of biosensors that are located on the surface of a substrate which forms the bottoms of the wells. These open-air microplates perform well in most applications but there are some applications which require the use of flow-through assays (kinetic assays of association and dissociation) where a micro-fluidic microplate would be preferable to use instead of the open-air microplate. Unfortunately, the existing micro-fluidic microplates, suffer from a problem of maintaining a closed system so one or more fluids can be transferred from a fluid delivery system into the micro-fluidic microplate where they flow over the biosensors and are then removed from the micro-fluidic microplate without being exposed to the air and/or being spilled on top of the micro-fluidic microplate. In other words, there is often a leakage/sealing problem that occurs at the interface between these micro-fluidic microplates and the fluid delivery system.

To address this sealing/leakage problem, the assignee of the present invention has developed several different closed flow-through microplates which were disclosed and discussed in U.S. patent application Ser. No. 10/155,540 filed May 24, 2002 and entitled "Microcolumn-Based, High-Throughput Microfluidic Device" (the contents of this document are incorporated by reference herein). Although these closed flow-through microplates work well when performing a flow-through assay there is still a desire to improve upon and enhance the existing closed flow-through microplates. This particular need and other needs have been satisfied by the present invention

SUMMARY

The present invention provides a closed flow-through microplate which is configured as a microplate 2-plate stack that has an upper plate (well plate) attached to a lower plate (sensor plate). The upper plate has a top surface, a body and a bottom surface. The top surface has located thereon a sealing substance which has one or more fluid delivery/removal sealing interfaces where each fluid delivery/removal sealing interface has one or more inlet ports and one or more outlet ports. The body has one or more fluid delivery/removal channels extending therethrough where each fluid delivery/removal channel has one or more inlet channels and one or more outlet channels which are respectively aligned with the one or more inlet ports and the one or more outlet ports located within the corresponding fluid delivery/removal sealing interface. The lower plate has a top surface which is attached to the bottom surface of the upper plate such that one or more flow chambers are present there between, where each one of the flow chambers is in communication with a corresponding one of the fluid delivery/removal channels extending through the body of the upper plate. In addition, the present invention provides methods for the use and the manufacture of the closed flow-through microplate.

BRIEF DESCRIPTION OF THE DRAWINGS

A more complete understanding of the present invention may be had by reference to the following detailed description when taken in conjunction with the accompanying drawings wherein.

DETAILED DESCRIPTION

Figure 1A:
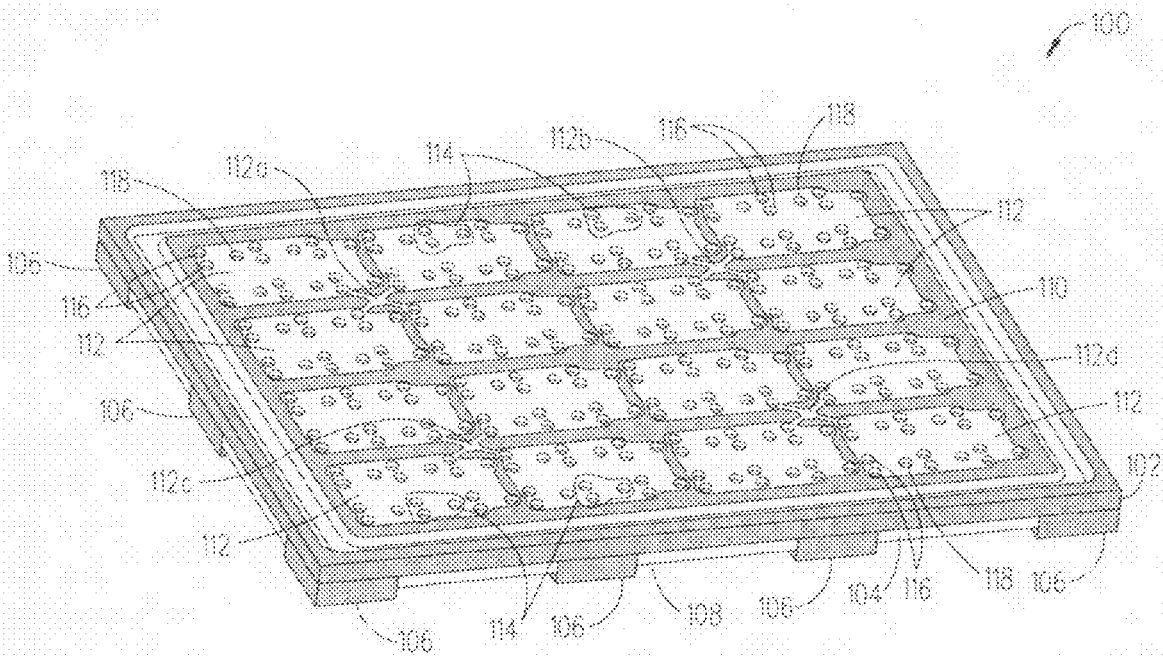
FIGS. 1A-1E are drawings illustrating different views of a closed flow-through microplate in accordance with the present invention.

Referring to FIGS. 1A-1E, there are several drawings illustrating different views of an exemplary 96-well closed flow-through microplate 100 in accordance with the present invention (note: the closed flow-through microplate 100 can have any number of wells such as for example 96, 384 or 1536 wells). In FIG. 1A, there is a perspective view of the 96-well closed flow-through microplate 100 which is configured as a microplate 2-plate stack that has an upper plate 102 (well plate 102) attached to a lower plate 104 (sensor plate 104) (note: the microplate 100 is shown with some "shaded areas" but would normally be transparent where the "shaded areas" are used here to help explain the different features of the microplate 100). The well plate 102 has a series of peripheral supports 106 extending downward therefrom which rest on a surface (e.g., table, support platform) and protect a bottom surface 108 of the sensor plate 104.

Figure 1B:
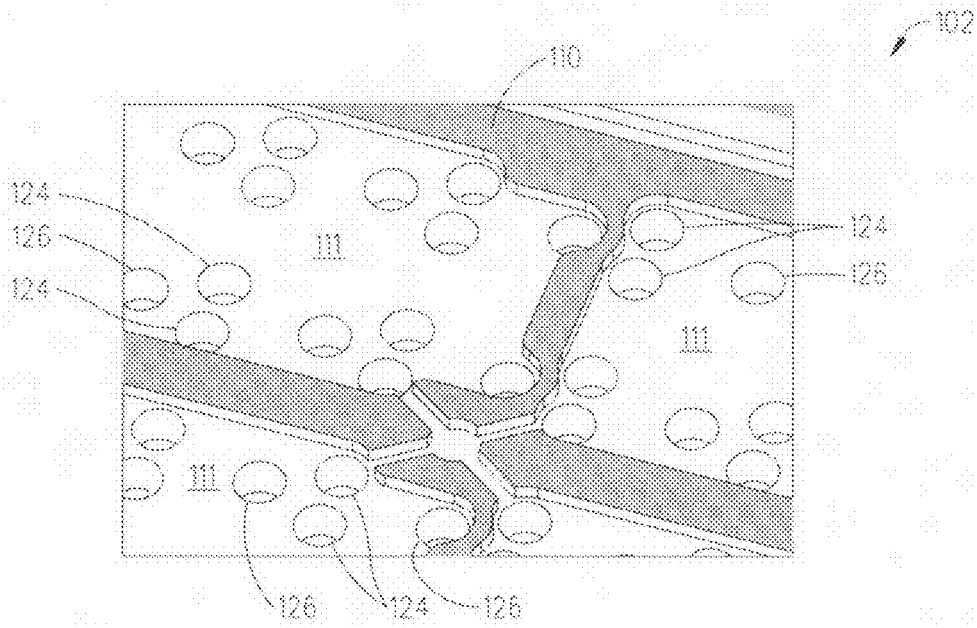

The well plate 102 has a top surface 110 on which there is a sealing substance 112 which is divided into 96-fluid delivery/removal sealing interfaces 114 (note: the sealing substance 112 has four distinct sections 112*a*, 112*b*, 112*c* and 112*d*). In this example, each of the fluid delivery/removal sealing interfaces 114 has two inlet ports 116 and one outlet port 118. However, each of the fluid delivery/removal sealing interfaces 114 could have any number of inlet ports 116 and any number of outlet ports 118. For example, each fluid delivery/removal sealing interface 114 could have three inlet ports 116 and three outlet ports 118. Or, each fluid delivery/removal sealing interface 114 could have one inlet port 116 and one outlet port 118. FIG. 1B is a partial view of the top surface 110 of the well plate 102 which shows depressions 111 located therein in which the sealing substance 112 will be deposited.

Figure 1C:
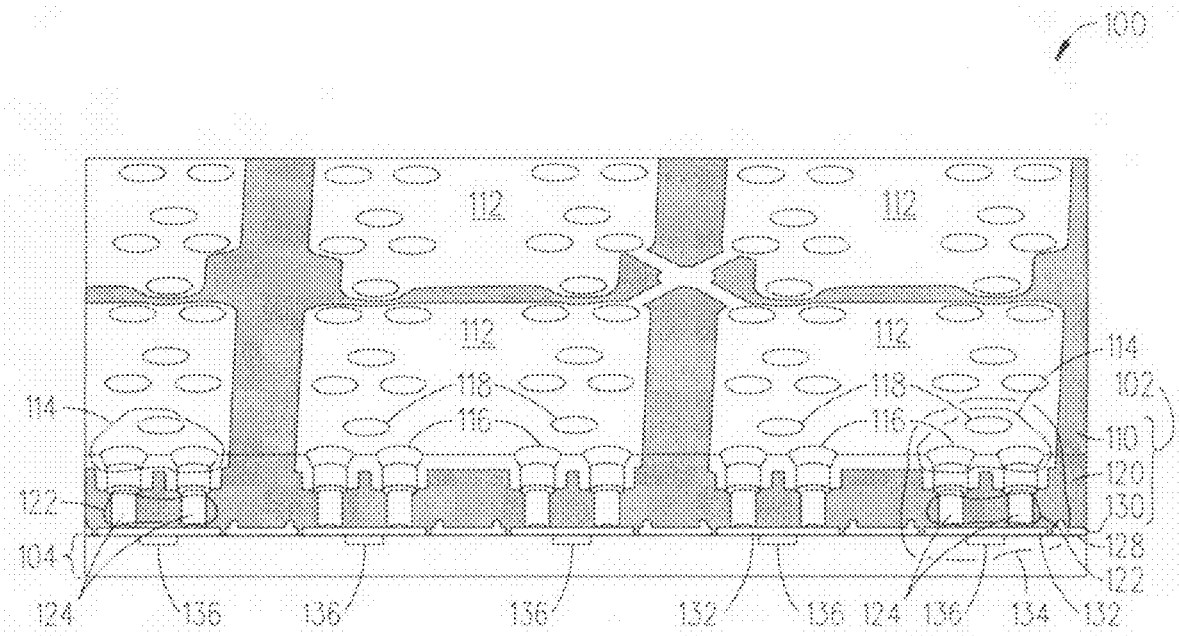
Figure 1D:
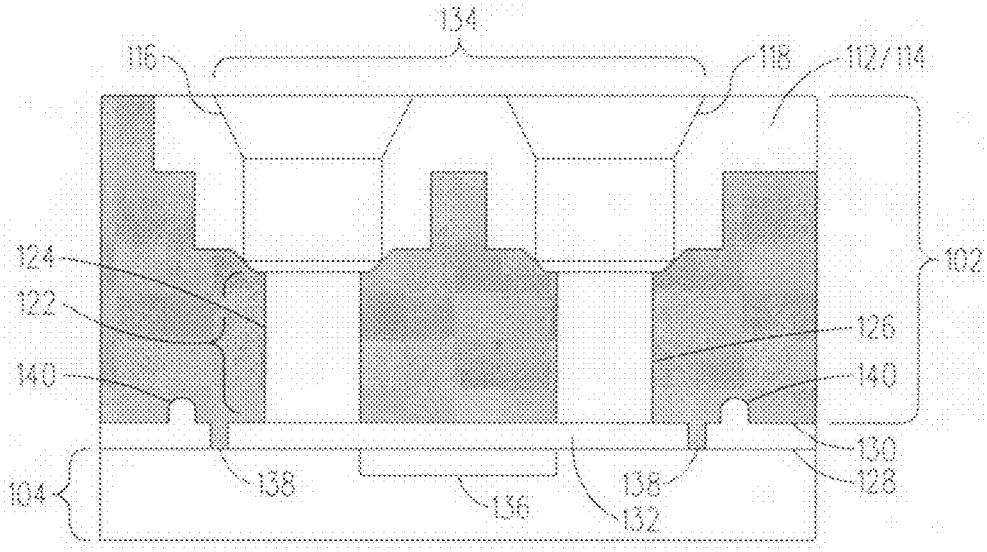
Figure 1E:
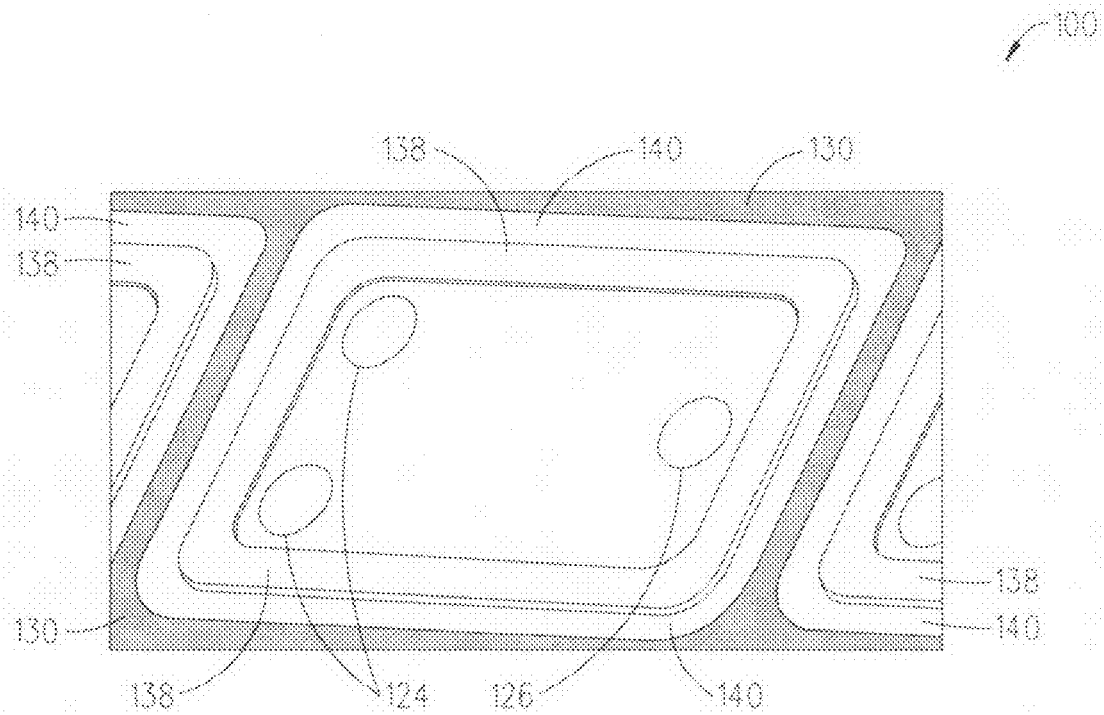

In FIG. 1C, there is an isometric view of a partial sectioned microplate 100. As can be seen, the well plate 102 has a body 120 with an array of 96-fluid delivery/removal channels 122. Each set of fluid delivery/removal channels 122 includes two inlet channels 124 and one outlet channel 126 (note: the outlet channel 126 is shown in FIG. 1D). Plus, each set of fluid delivery/removal channels 122 is aligned with a corresponding one of the fluid delivery/removal sealing interfaces 114 such that the inlet channels 124 are aligned with the inlet ports 116 and the outlet channel 126 is aligned with the outlet port 118. In addition, the microplate 100 includes the sensor plate 104 which has a top surface 128 attached to a bottom surface 130 of the well plate 102 such that there is one flow chamber 132 formed therein which corresponds with each fluid delivery/removal channel 122 that includes two inlet channels 124 and one outlet channel 126 which extend through the body 120 and open at the bottom surface 130 of the well plate 102. As can be seen, the sensor plate 104 also has biosensors 136 incorporated therein such that there is one biosensor 136 associated with each flow chamber 132 (note: if desired there can be more than one biosensor 136 associated with each flow chamber 132).

In FIG. 1D, there is a cross-sectional side view of one well 134 located within the microplate 100 (note: this is a different view than the wells 134 shown in FIG. 1C). As can be seen, each well 134 includes one fluid delivery/removal sealing interface 114 (sealing substance 112) that is located on the top surface 110 of the well plate 102. The fluid delivery/removal sealing interface 114 includes two inlet ports 116 (only one shown) and one outlet port 118 which are connected to one of the fluid delivery/removal channels 122 which includes two input channels 124 (only one shown) and one output channel 126 all of which open-up into the flow chamber 132. As shown, the flow chamber 132 (flow-through channel 132) interconnects the two inlet ports 116/inlet channels 124 and the outlet port 118/outlet channel 126 to form a closed fluid delivery/removal system. The sensor plate 104 also has one biosensor 136 incorporated therein that has a sensing surface within the flow chamber 132. For instance, the biosensor 136 could be a surface plasmon resonance (SPR) sensor or a waveguide grating coupler (WGC) sensor. A detailed discussion about the WGC sensor 136 has been provided in U.S. Pat. No. 4,815,843 (the contents of which are incorporated by reference herein).

The well plate 102 and sensor plate 104 can be attached to one another by using anyone of several different attachment schemes. For instance, the well plate 102 may have a bottom surface 130 which has ridge(s) 138 extending therefrom which enables the formation of the flow chamber(s) 132 when the well plate 102 is attached to the sensor plate 104 (see FIGS. 1D-1E which illustrate a ridge 138 that creates a flow chamber 132 when the well plate 102 is attached to the sensor plate 104). If desired, the bottom surface 130 of the well plate 102 can also have channels 140 formed therein which extend outside a perimeter of the ridges 138 (see FIGS. 1D-1E). Each channel 140 is sized to contain the overflow of an adhesive (not shown) which is used to attach the well plate 102 to the sensor plate 104. Alternatively, a two-sided pressure sensitive adhesive film can be placed between and used to attach the well plate 102 to the sensor plate 104. In this case, the film has sections removed therefrom in a manner that each removed section forms one of the flow chambers 132 when the well plate 102 is attached to the sensor plate 104 (note: the film if used would negate the need to form the ridge(s) 138 and channel(s) 140 in the bottom surface 130 of the well plate 102).

Figure 2A:
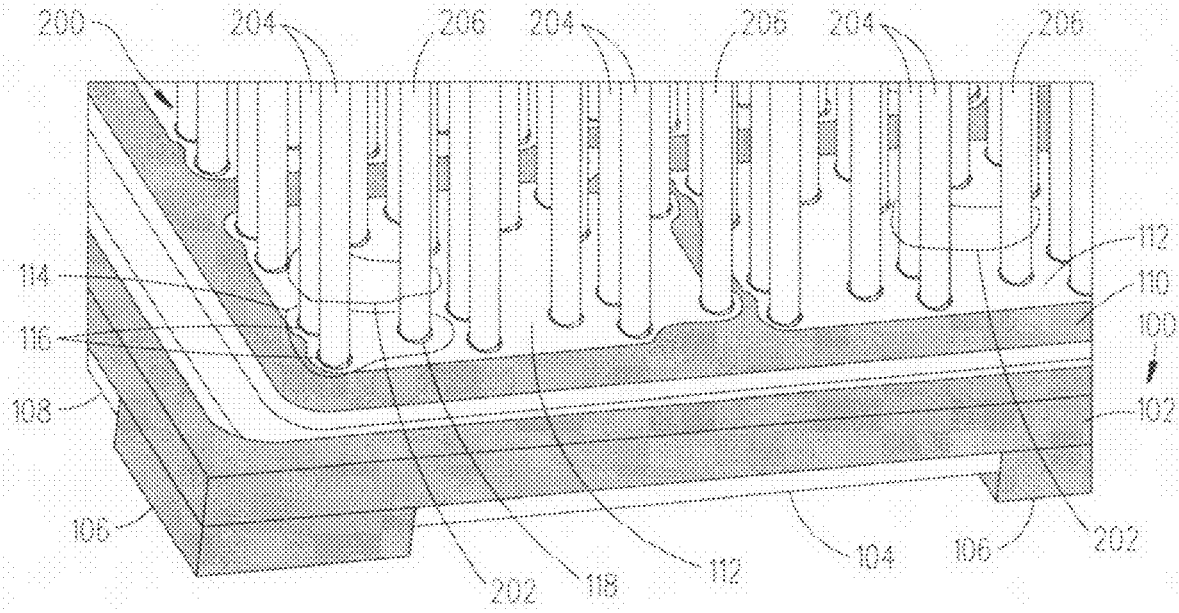
FIGS. 2A-2B are drawings illustrating a fluid delivery system coupled to the closed flow-through microplate in accordance with the present invention.
Figure 2B:
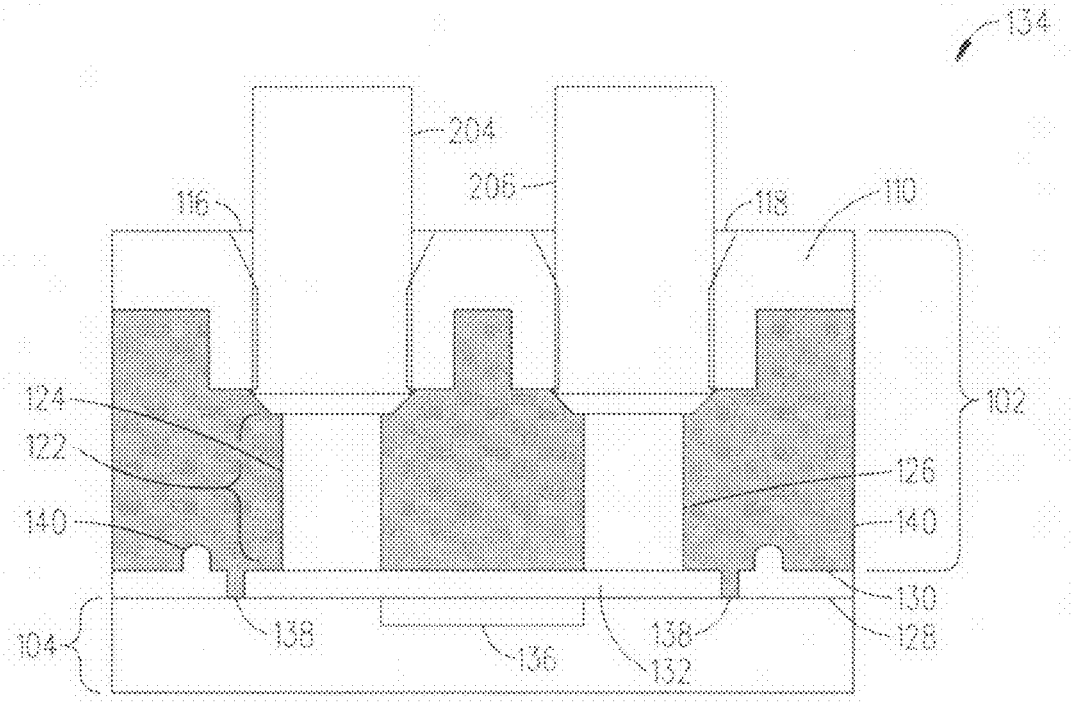

Referring to FIGS. 2A-2B, there are two drawings illustrating a fluid delivery system 200 coupled to the closed flow-through microplate 100 in accordance with the present invention. In FIG. 2A, there is a partial perspective view of the fluid delivery system 200 securely connected via leak-free seals to the 96-well closed flow-through microplate 100. The fluid delivery system 200 has 96 sets of fluid delivery/removal tips 202 where each set of fluid delivery/removal tips 202 has two fluid delivery tips 204 and one fluid removal tip 206. In operation, each set of fluid delivery/removal tips 202 are inserted into the corresponding fluid delivery/removal sealing interface 114 on the microplate 100. In particular, each set of fluid delivery/removal tips 202 has two fluid delivery tips 204 and one fluid removal tip 206 respectively inserted into the two inlet ports 116 and the one outlet port 118 in the corresponding fluid delivery/removal sealing interface 114 on the microplate 100 (note: if desired the sealing substance 112 can be o-rings that are inserted into counter-bored channels 124 and 126 located within the well plate 102). As can be seen in FIG. 2B, the two fluid delivery tips 204 (only one shown) and the one fluid removal tip 206 each have a diameter that is slightly larger than the inner diameter of the two inlet ports 116 and the one outlet port 118 in the fluid delivery/removal sealing interface 114. This difference in diameters enables a liquid tight seal to be formed between the two fluid delivery tips 204 and the two inlet ports 116 and between the one fluid removal tip 206 and the one outlet port 118 (note: FIG. 2B is the same as FIG. 1D except that two fluid delivery tips 204 (only one shown) and one fluid removal tip 206 are inserted into the well 134 of the microplate 100). An exemplary fluid delivery system 200 that could be used in this application has been described in co-assigned U.S. Provisional Patent Application Ser. No. 60/817,724 filed Jun. 30, 2006 and entitled "Fluid Handling System for Flow-Through Assay" (the contents of this document are incorporated by reference herein).

Figure 3:
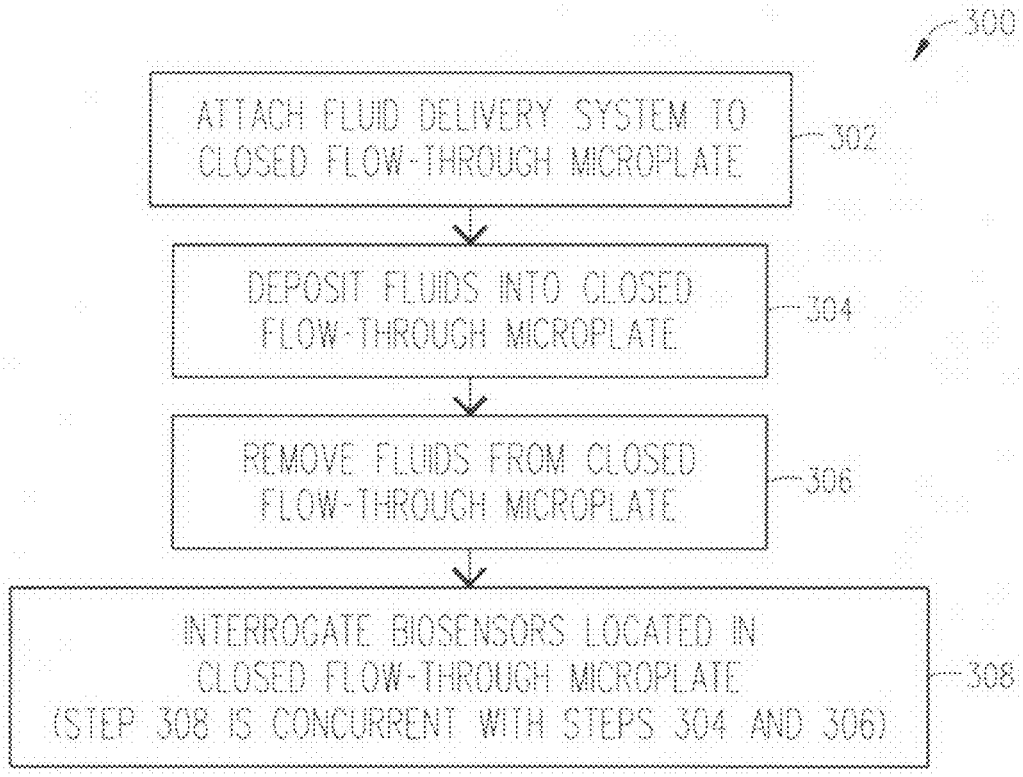
FIG. 3 is a flowchart illustrating the steps of a method for using the closed flow-through microplate to perform a flow-through assay in accordance with the present invention.

Referring to FIG. 3, there is a flowchart illustrating the steps of a method 300 for using the closed flow-through microplate 100 to perform a flow-through assay in accordance with the present invention. Beginning at step 302, the fluid delivery system 200 and in particular the sets of fluid delivery/removal tips 202 are attached via compression-like seals to the microplate 100 (see FIGS. 2A-2B). In this example, each set of fluid delivery/removal tips 202 has two fluid delivery tips 204 and one fluid removal tip 206 respectively inserted into the two inlet ports 116 and one outlet port 118 in the corresponding fluid delivery/removal sealing interface 114 on the microplate 100.

Figure 4:
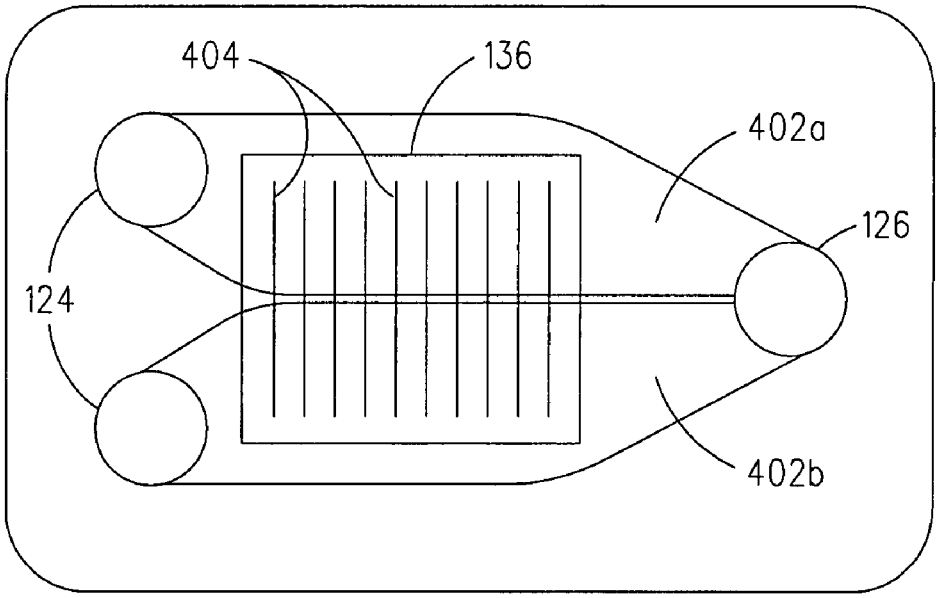
FIG. 4 is a diagram illustrating how two fluids can flow over a biosensor which is located within the closed flow-through microplate in accordance with the present invention.

At step 304, the fluid delivery system 200 inserts two fluids through one or more sets of the fluid delivery/removal tips 202 and in particular through their fluid delivery tips 204 such that both fluids flow through the flow chamber(s) 132 within the microplate 100 (note: the two fluids 402*a* and 402*b* would normally flow perpendicular to the grooves/diffraction gratings 404 associated with the biosensor 136—see FIG. 4). Typically, the fluid delivery system 200 inserts the two fluids with a predetermined volume and pressure such that each fluid flows substantially parallel to one another with little or no mixing or turbulence between them as both fluids flow over the biosensor 136 and out of the outlet channel 126. In one case, the fluid delivery system 200 controls the flow of the two fluids such that each fluid flows over roughly the same amount of surface area on the biosensor 136. Alternatively, the fluid delivery system 200 can control the flow of the two fluids such that one of the two fluids flows over a larger portion of the surface area on the biosensor 136. In yet another alternative, the fluid delivery system 200 could flow one fluid for a period of time and then only flow a second fluid immediately after the first fluid is shut-off to create a temporal division in the fluids as compared to a spatial division between the fluids. At step 306, the fluid delivery system 200 receives the two fluids through each of the one or more sets of the fluid delivery/removal tips 202 and in particular through their fluid removal tips 206 after they have flowed through the corresponding flow chamber(s) 132 and over the corresponding biosensor(s) 136 within the microplate 100.

At step 308, an interrogation system (not shown) can interrogate the biosensor(s) 136 to detect any changes in the refractive index at or near their sensing surface(s) while the two fluids are flowing within the flow chamber(s) 132 of the microplate 100 (note: step 308 is performed concurrently with steps 304 and 306). For instance, the interrogation system can be used to perform a label independent kinetic flow through assay to detect biomolecular interactions like material bindings, adsorptions etc. . . that is helpful when testing new drugs. An exemplary interrogation system which could interrogate the microplate 100 has been described in a co-assigned U.S. patent application Ser. No. 11/489,173 (the contents of which are hereby incorporated by reference herein). Plus, a discussion about how the interrogation system can perform intra-cell self referencing to help mitigate the uncertainties due to environmental conditions by having two fluids (one sample solution and one reference solution) flow over a single biosensor is provided in a co-assigned U.S. patent application Ser. No. 10/993,565 (the contents of which are hereby incorporated by reference herein).

Figure 5:
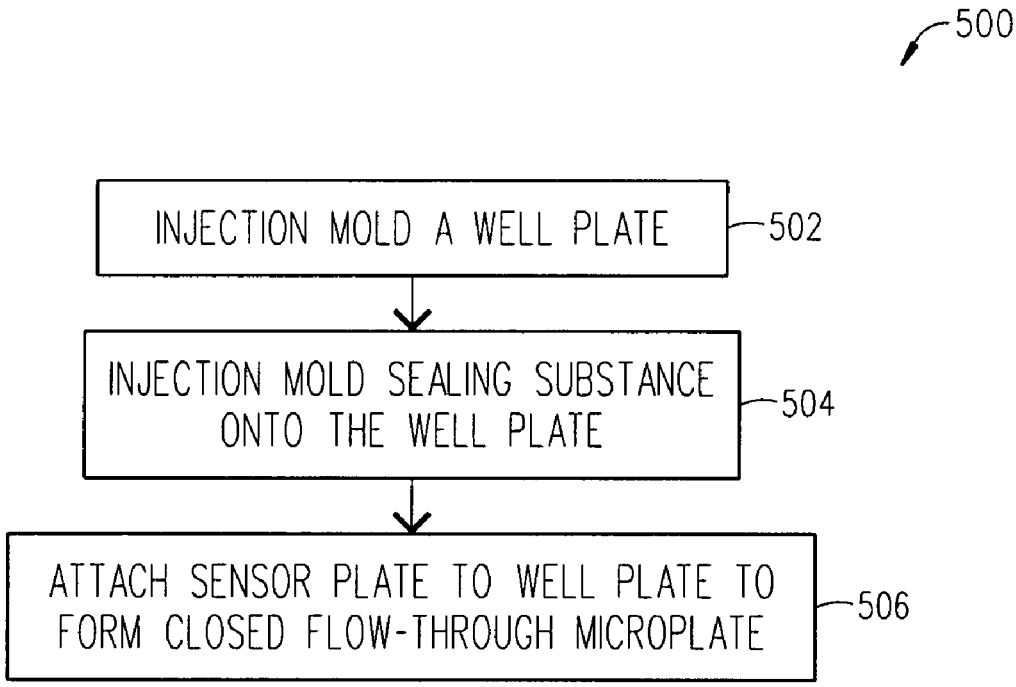
FIG. 5 is a flowchart illustrating the steps of a method for manufacturing the closed flow-through microplate in accordance with the present invention.

Referring to FIG. 5, there is a flowchart illustrating the steps of a method 500 for manufacturing the closed flow-through microplate 100 in accordance with the present invention. Beginning at step 502, a first mold is used to injection mold the well plate 102 that includes the top surface 110 (which has one or more depressions 111 formed thereon which are configured to receive the sealing substance 112—see FIG. 1B), the body 120 (including the fluid delivery/removal channels 122) and the bottom surface 130 (including the ridges 138 and the channels 140). For example, the well plate 102 can be made from materials such as cyclo-olefin, polyurethane, acrylic plastics, polystyrene and polyester.

At step 504, a second mold is used to injection mold the sealing substance 112 (which forms the fluid delivery/removal sealing interfaces 114) into the depressions 111 located on the top surface 110 of the well plate 102 (see FIG. 1C). The sealing substance 112 (or the fluid delivery/removal sealing interfaces 114) can be made from any type of elastomeric-type material or silicone.

At step 506, the sensor plate 104 has a top surface 128 that is attached via an adhesive to the bottom surface 130 of the well plate 102 in a manner so as to form the flow chamber(s) 132 (see FIG. 1D). For example, the flow chamber(s) 132 can have a height that is preferably between about 5 microns and about 200 microns and more preferably in the range of 60 microns (where height refers to the distance from the bottom surface 130 of the well plate 102 to the top surface 128 of the sensor plate 104). Alternatively, the sensor plate 104 can be attached to the well plate 102 with a two-side pressure sensitive adhesive film. In one embodiment, the closed flow-through microplate 100 has a footprint and physical dimensions that are in accordance with the Society of Biomolecular Screening (SBS) standards so that it can be interfaced with a standard fluid delivery/removal system 200 and also be handled by a standard robot handling system.

Although several embodiments of the present invention have been illustrated in the accompanying Drawings and described in the foregoing Detailed Description, it should be understood that the invention is not limited to the embodiments disclosed, but is capable of numerous rearrangements, modifications and substitutions without departing from the spirit of the invention as set forth and defined by the following claims.

The invention claimed is:

1. A microplate, comprising: an upper plate including a top surface, a body and a bottom surface, where: said top surface has located thereon a sealing substance which has one or more fluid delivery/removal sealing interfaces where each fluid delivery/removal sealing interface has one or more inlet ports and one or more outlet ports; and said body has one or more fluid delivery/removal channels extending therethrough where each fluid delivery/removal channel has one or more inlet channels and one or more outlet channels which are respectively aligned with the one or more inlet ports and the one or more outlet ports located within the corresponding fluid delivery/removal sealing interface of said sealing substance; and a lower plate including a top surface which is attached to said bottom surface of said upper plate such that one or more flow chambers are present there between, where each one of the flow chambers is in communication with a corresponding one of the fluid delivery/removal channels extending through said body of said upper plate; wherein said bottom surface of said upper plate has one or more ridges extending therefrom and encompassing the one or more fluid delivery/removal channels which enables the formation of the one or more flow chambers when said upper plate is attached by an adhesive to said lower plate; wherein said bottom surface of said upper plate has one or more channels formed therein that contain an overflow of the adhesive which extend outside a perimeter of the one or more ridges.

2. The microplate of claim 1, wherein each flow chamber has a height that is between about 5 microns and about 200 microns.

3. The microplate of claim 1, wherein said lower plate has one or more biosensors incorporated therein such that at least one of the biosensors has a sensing surface located within one of the flow chambers.

* * * * *